United States Patent [19]

Hartman et al.

[11] Patent Number: 4,974,833

[45] Date of Patent: Dec. 4, 1990

[54] ELECTRONIC MARTIAL ARTS TRAINING DEVICE

[75] Inventors: Kenneth D. Hartman, DeKalb; Steven A. Overmyer, Elgin, both of Ill.

[73] Assignees: Kyung S. Shin; Sandra S. Shin, both of Chicago, Ill.

[21] Appl. No.: 351,009

[22] Filed: May 21, 1989

[51] Int. Cl.[5] ..... A63B 69/00

[52] U.S. Cl. ..... 272/76; 273/1 G E

[58] Field of Search ..... 272/76, DIG. 5; 434/258; 273/1 GE, 376

[56] References Cited

U.S. PATENT DOCUMENTS

| | | | |
|---|---|---|---|
| 3,933,354 | 1/1976 | Goldfarb et al. | 273/1 E |
| 4,088,315 | 5/1978 | Schemmel | 272/76 |
| 4,761,005 | 8/1988 | French et al. | 273/1 GC |
| 4,818,234 | 4/1989 | Redington et al. | 434/247 |

FOREIGN PATENT DOCUMENTS

| | | | |
|---|---|---|---|
| 1203258 | 4/1986 | Canada | 272/76 |

*Primary Examiner*—Randall L. Green

*Assistant Examiner*—David H. Willse

*Attorney, Agent, or Firm*—Andrew J. Dillon

[57] ABSTRACT

An electronic martial arts training device is disclosed. The martial arts training device of the present invention includes a pliable substrate of sufficient thickness to absorb a full impact martial arts blow without injuring the deliverer thereof. A pictorial representation of a martial arts combatant is disposed on one surface of the pliable substrate and a plurality of target lights are disposed within the pliable substrate beneath the pictorial representation at locations which correspond to the "vital-points" of the pictured combatant. Mounted within the pliable substrate in conjunction with each target light is a miniature loud speaker having a vibratable cone and a pair of electrical terminals which are coupled to the vibratable cone via a movable coil. Vibrations induced into the vibratable cone by the impact of a martial arts blow will result in an electrical signal being generated at the electrical terminals. A control circuit is then utilized to selectively illuminate the target lights and couple the electrical signal output by each associated miniature loud speaker to a scoring indicator which provides an indication of a student's proficiency.

22 Claims, 3 Drawing Sheets

ELECTRONIC MARTIAL ARTS TRAINING DEVICE

BACKGROUND OF THE INVENTION

1. Field of the Invention:

This invention relates in general to martial arts training devices and in particular to electronic martial arts training devices. Still more particularly the present invention relates to electronic martial arts training devices capable of withstanding a full impact martial arts blow without injuring the deliverer thereof.

2. Description of the Prior Art:

Students of Karate, Kung Fu, Tae Kwon Do and boxing have for many years trained by hitting or kicking striking pads or bags of various descriptions. Many such pads or bags include an illustration of a combatant so that the student may practice aiming blows at particular points on the combatant's body. With all such kicking or striking pads or bags, the student must set his own pace, choose a selected target and determine the rhythm of his practice.

It is also possible to train in the martial arts by working in conjunction with a trainer wearing padded gloves. The trainer preferably positions these "target" gloves at various locations and permits the student to practice striking the gloves as directed by the trainer. While this represents an enhancement over the utilization of static striking pads or bags the student soon learns the trainer's habits and this method also requires the participation of a second person. Actual sparring requires a partner and is of limited value due to the fact that both partners soon grow familiar with the other partner's style, preferences and weaknesses. Similarly, it is difficult to train in this manner utilizing full impact blows without the possibility of injuring one's sparring partner. Several mechanical Karate fighters such as the one disclosed in U.S. Pat. No. 3,804,406, issued to Visciione on Apr. 16, 1974 are known; however these devices are unnecessarily complex and expensive.

A reflex testing amusement device is disclosed in U.S. Pat. No. 3,933,354, issued to Adolph E. Goldfarb et al. on Jan. 20, 1976. The Goldfarb et al. device discloses a planar substrate having a pictorial representation of a martial arts combatant thereon. A plurality of target lights are hidden beneath the pictorial representation and are selectively illuminated by a control device so that the person using the device may attempt to strike the pictorial representation in the vicinity of the target light. A microswitch is disposed in the vicinity of each target light and is utilized to detect the touching or hitting of the planar surface by the person utilizing the device in response to the illumination of a target light.

The Goldfarb et al. device has several distinct short falls which prevent it being utilized by serious students of the martial arts. For example, the plastic actuator which must be depressed in order to actuate the microswitch is of a rigid tinted transparent plastic and is firmly mounted within an aperture within the planar device. Thus, a full impact martial arts blow cannot be applied to the target light without the possibility of damaging the plastic switch or injuring the participant. Similarly, the microswitch associated with each target light is a simple electronic switch which will only record the absence or presence of a depression of the target switch without providing an indication of the amplitude of the blow which has been struck.

Thus, it should be obvious that a need exists for a martial arts training device which is capable of withstanding full contact martial arts blows without damaging the device or injuring the participant. Further, it would be advantageous to provide such a device which is capable of providing an indication of the relative intensity of the student's blow.

SUMMARY OF THE INVENTION

It is therefore one object of the present invention to provide an improved martial arts training device.

It is another object of the present invention to provide an improved electronic martial arts training device capable of withstanding a full impact martial arts blow without damaging the device or injuring the participant.

It is yet another object of the present invention to provide an improved electronic martial arts training device capable of withstanding a full impact martial arts blow without damaging the device or injuring the participant which provides an indication of the relative intensity of the martial arts blow.

The foregoing objects are achieved as is now described. The martial arts training device of the present invention includes a pliable substrate of sufficient thickness to absorb a full impact martial arts blow without injuring the deliverer thereof. A pictorial representation of a martial arts combatant is disposed on one surface of the pliable substrate and plurality of target lights are disposed within the pliable substrate beneath the pictorial representation at locations which correspond to the "vital-points" of the pictured combatant. Mounted within the pliable substrate in conjunction with each target light is a miniature loud speaker having a vibratable cone and a pair of electrical terminals which are coupled to the vibratable cone via a module coil. Vibrations induced into the vibratable cone by the impact of a martial arts blow will therefore result in an electrical signal being generated at the electrical terminals of a miniature loud speaker. A control circuit is utilized to randomly and selectively illuminate the target lights and couple the electrical signal output by each associated miniature loud speaker to a scoring indicator to provide an indication of a student's proficiency.

The above as well as additional objects, features, and advantages of the invention will become apparent in the following detailed description.

BRIEF DESCRIPTION OF THE DRAWING

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
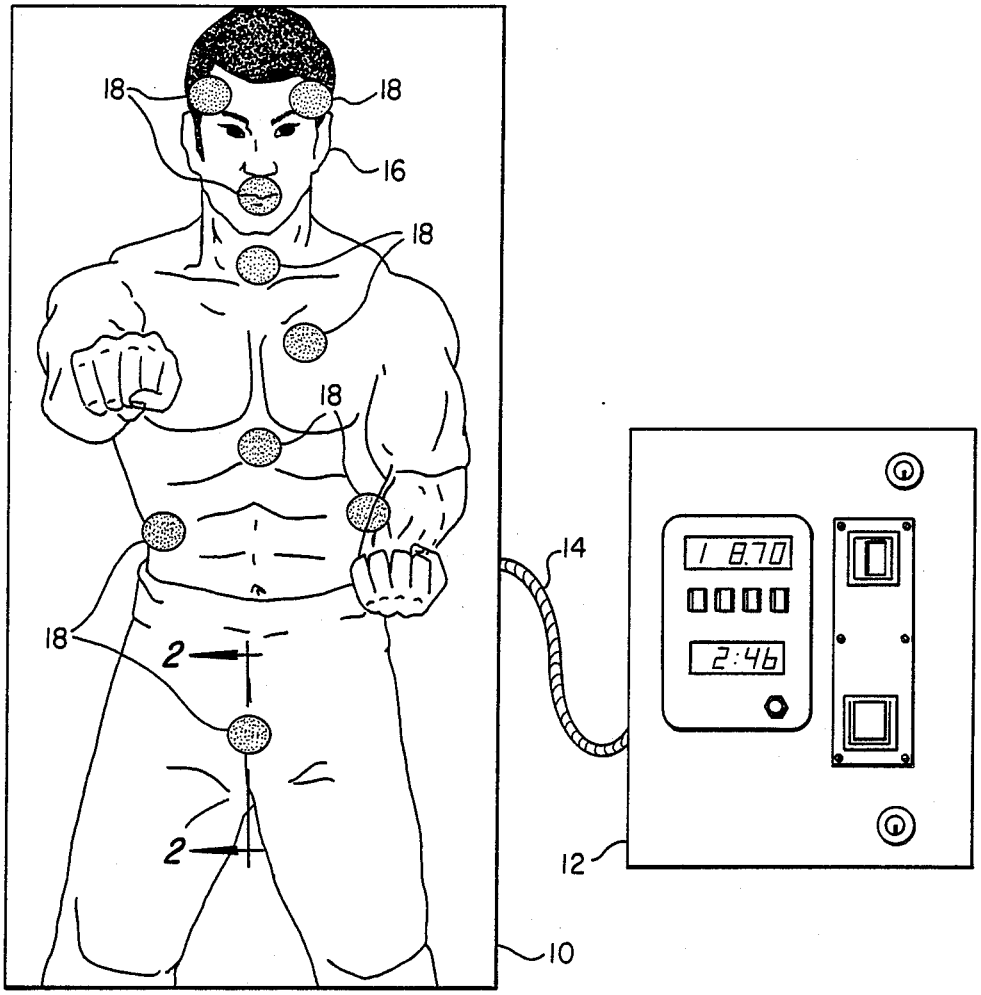
FIG. 1 is a pictorial representation of the electronic martial arts training device of the present invention.

With reference now to the figures and in particular with reference to FIG. 1, there is depicted a pictorial representation of the electronic martial arts training device of the present invention. As may be seen, the electronic martial arts training device of the present invention is divided into two main subassemblies. Target section 10 and control section 12. Target section 10 and control section 12 are electronically connected via wiring harness 14 and operate together in a manner which will be explained in greater detail herein. As may be seen, target section 10 includes a pictorial representation of a martial arts FIG. 16. Displayed at various "vital-points" on martial arts FIG. 16 are multiple target modules 18. Each such target module 18 represents a location on an opponent's body which a martial art practitioner must repeatedly practice striking. Although each target module 18 is disclosed within FIG. 1 as a circular discontinuity on the representation of martial arts FIG. 16, it should be appreciated that each target module may be provided by an indicating means which is not continuously visible.

Figure 2:
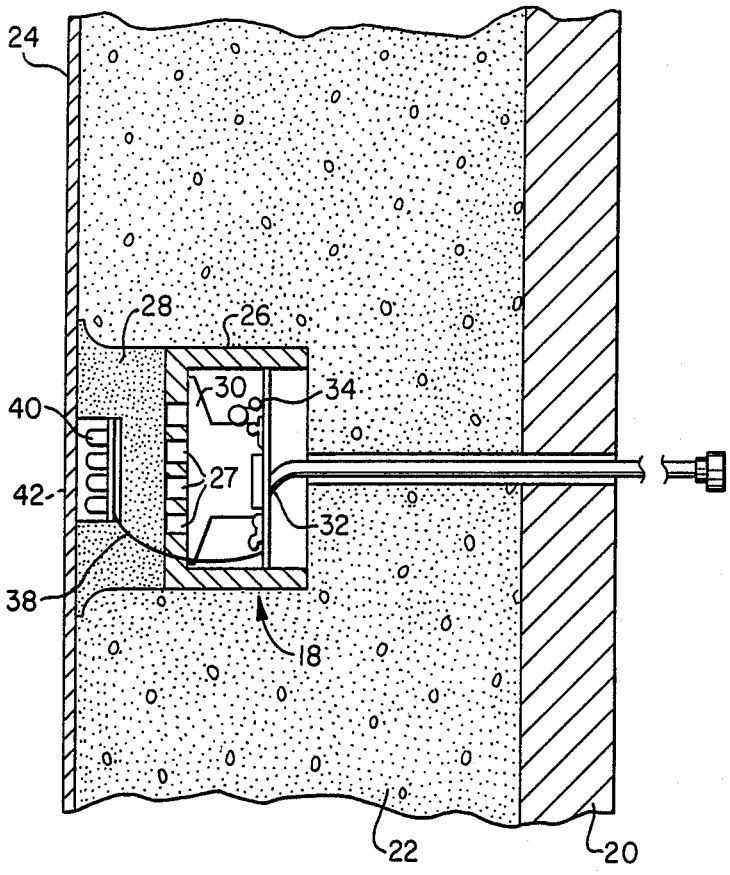
FIG. 2 is a sectional view of a target module of the electronic martial arts training device of FIG. 1, taken along line 2—2 of FIG. 1.

Referring now to FIG. 2, there is illustrated a sectional view of a target module 18 of the electronic martial arts training device of FIG. 1 which is taken along line 2—2 of FIG. 1. As may be seen, target section 10 is constructed by utilizing a backing board 20 which may be constructed of a wooden or metallic planar member of sufficient rigidity to support the remaining components of target section 10 Mounted to one surface of backing board 20 is a layer of molded synthetic elastic 22. Molded synthetic elastic section 22 is preferably constructed of polyurethane and is at least two inches in thickness. Molded synthetic elastic section 22 is preferably rigid enough to simulate a human body when struck yet pliable enough to ensure that the student practicing will not be injured by striking a full impact martial arts blow to the surface thereof.

Mounted to the forward surface of molded foam section 22 is a tinted transparent layer 24 which preferably is utilized to apply the pictorial representation of martial arts FIG. 16 (see FIG. 1) to the surface thereof. Located beneath tinted transparent layer 24 at various points throughout the surface of target section 10 are a plurality of target modules 18, such as the target module 18 illustrated in FIG. 2. As may be seen, each target module 18 is mounted within an aperture in molded sYnthetic elastic section 22 and includes a sensor enclosure which is preferably constructed of plastic and which includes a plurality of apertures 27 in the forward face thereof.

Sensor enclosure 26 serves to mount miniature loud speaker cone 30 and target module circuit board 34. Those skilled in the electronic art will appreciate that the principle upon which loud speakers operate generally involves the coupling of a variable electrical signal to a pair of electronic terminals 32 which are coupled to a movable electric coil (not shown) which is mounted in the vicinity of a permanent magnet. The movable electric coil is then attached to a vibratable cone constructed of paper or polypropylene and the transient magnetic fields established by the electronic signals coupled thereto react with the static magnetic field of the permanent magnet to induce vibration into the vibratable cone of the loud speaker.

Target module 18 of the present invention operates in exactly the Opposite manner. That is, the vibrations induced by a martial arts blow to the surface of tinted transparent layer 24 in the vicinity of target module 18 are transmitted via display foam module 28, which is preferably constructed of a synthetic elastic and thereafter induce vibrations into vibratable cone 30 of the miniature loud speaker. These induced vibrations are then mechanically transmitted to a movable electric coil (not shown) which is coupled to the cone. The movement of this coil in the vicinity of a permanent magnet will thereafter induce electronic signals at electrical terminals 32.

This particular approach has several unique advantages over the utilization of a mechanical switch in that it is not necessary to directly couple the force of the blow to a switch, thus making it possible for the practitioner to strike a softly padded foam rubber impact surface without the possibility of damaging the device or injuring the practitioner. Additionally, by utilizing a miniature loud speaker in this manner it is possible to determine the relative amplitude of the blow as it is struck due to the fact that the amount of vibration induced into miniature loud speaker cone 30 will generate a variable electronic signal at electrical terminals 32 which is proportional to the amount of vibration induced.

Mounted within a molded aperture of display foam module 28 is a light emitting diode (LED) display array 40 which is preferably electronically coupled to target module circuit board 34 via display wiring harness 38. The light emitting diodes within LED display array 40 are preferably enclosed within a section of flexible transparent potting material 42 and may therefore be struck repeatedly with a full impact martial arts blow without damaging either the LED display array 40 or the hand or foot of the student utilizing the device. In the depicted embodiment of the present invention LED display array 40 is preferably enclosed within a potting material such as silicone, which has the beneficial effect of diffusing the outputs of each LED to provide a wider illumination area. Thus, a particular target module 18 may be actuated by illuminating LED display array 40 temporarily and thereafter detecting vibrations induced in the vicinity thereof for a selected period of time by generating an electronic signal in response to vibrations of miniature loud speaker cone 30 in the manner described above.

Figure 3:
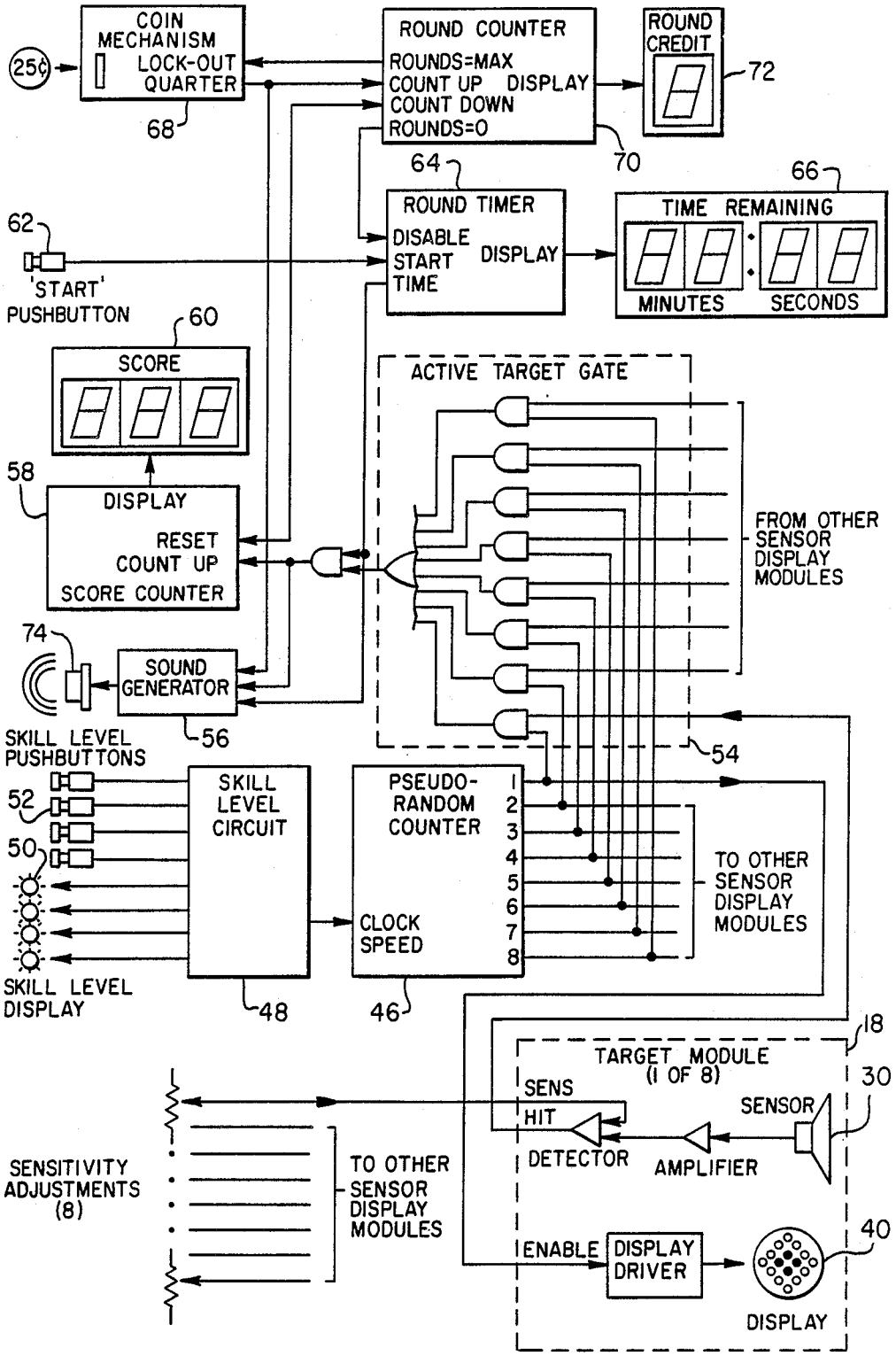
FIG. 3 is an electronic block diagram illustrating the circuitry of the electronic martial training device of the present invention.

With reference now to FIG. 3, there is depicted an electronic block diagram which illustrates the circuity of the electronic martial arts training device of the present invention. As may be seen, each target module 18 includes miniature loud speaker cone 30 and LED display array 40. As is illustrated in FIG. 3, the individual light emitting diodes within LED display array 40 are preferably arranged in at least two concentric geometric figures such as the two diamonds illustrated in FIG. 3. In accordance with one feature of the illustrated embodiment of the present invention, pseudorandom counter 46 is utilized to selectively illuminate a particular target module by enabling a display driver which alternately illuminates first one concentric geometric figure and then the other geometric figure. By selectively illuminating the outer figure and then the inner figure it will be possible to create a "bull's-eye" impression in the field of vision of the student utilizing the device, drawing his attention to a particular target module.

Skill level circuit 48 is preferably utilized in conjunction with skill level push buttons 52 and skill level display 50 to permit a particular student to select the skill level at which he wishes to practice. By selecting a higher skill level the student will increasingly minimize the amount of time within which he must react to the illumination of a particular target module 18 in order to successfully score, utilizing the electronic martial arts training device of the present invention.

In the manner described above, a full impact martial arts blow which lands in the vicinity of miniature loud speaker cone 30 will induce sufficient mechanical vibrations so that an electronic signal will be generated. This signal will be detected and amplified by standard circuitry disposed on target module circuit board 34 (see FIG. 2) and then coupled to active target gate 54. Active target gate 54 preferably includes a plurality of AND gates which are individually enabled for a selected period of time after the illumination of a related LED display array 40, by pseudorandom counter 46. That is, the blow struck to a particular target module 18 must land within a selected period of time after the illumination of LED display array 40 to count as a successful blow. By utilizing skill level push buttons 52 and skill level circuit 48 this window of time may be increased or decreased to permit the student to select the difficulty of the exercise.

The output of active target gate 54 may then be applied to score counter 58 and sound generator 56 to generate an indication of the student's proficiency. In the depicted embodiment of the present invention, sound generator 56 may be coupled to an audio output device 74 which may then be utilized to generate a distinctive tone or sound in response to a successful blow struck by the student. Similarly, the output of active target gate 54 applied to score counter 58 may be utilized to provide a digital indication of score by utilizing score display 60. Of course, those skilled in the art will appreciate that additional circuitry may be utilized to provide a weighted score based upon the amount of impact detected due to the ability of the novel target module of the present invention to provide a signal which reflects the actual amplitude of the blow which is struck.

The circuitry displayed within FIG. 3 also includes a coin mechanism 68 which may be utilized to actuate the device by enabling round counter 70. Round counter 70 is merely a counting device which permits the operator of the device to enter sufficient coins to store a selected number of rounds which may be displayed via round display 72. Of course, the maximum number of rounds which may be entered into the device at one time is a matter of design choice.

The operation of the electronic martial arts training device of the present invention is then initiated by utilizing start push button 62 which begins the timing of a round as determined by round timer 64. A time remaining digital indicator may be provided such as round time display 66 to provide the student with an indication of how much time remains in each individual round.

Thus, in accordance with the depicted embodiment of the present invention a student may elect to participate for a selected number of rounds which will each last for a fixed period of time. During that time the student will be presented with a number of illuminated target modules which will be presented in a pseudo-random manner to test the student's skill at responding to such indications. By manipulating skill level push buttons 52 the student may determine how rapidly the target modules are illuminated and how long a period of time he has to respond to the illumination of an individual target module with a blow struck in the vicinity thereof.

Upon reference to the foregoing specification, those skilled in the art will appreciate that the Applicant has provided an electronic martial arts training device which may be mounted on a weighted stand or hung upon a wall to permit a martial arts student to practice the speed, power and reflexes necessary to excel in the martial arts. Unlike previously known training device, the electronic martial arts training device of the present invention permits a student to strike a full impact martial arts blow to multiple portions of the device without the possibility of damaging the device or injuring the student. This is accomplished by utilizing novel target modules which include vibration sensitive transducers rather than simple mechanical transducers to provide an indication of the amplitude of a martial arts blow.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. An electronic martial arts training device comprising:

a pliable substrate of sufficient thickness to absorb a full impact martial arts blow without injuring the deliverer thereof;

a pictorial representation of a plurality of martial arts targets disposed in front of said pliable substrate at multiple selected locations;

a plurality of target lights disposed within said pliable substrate;

a plurality of electronic vibration sensitive transducers each disposed within said pliable substrate in association with one of said plurality of target lights for detecting a martial arts blow in the vicinity thereof, each of said electronic vibration sensitive transducers generating an electrical signal at one of said multiple selected locations indicating the presence of a martial arts blow in the vicinity thereof, said electrical signal having an amplitude indicative of the force of said martial arts blow; and control means for selectively illuminating particular ones of said plurality of target lights and enabling an associated electronic vibration sensor transducer for a predetermined period of time thereafter.

2. The electronic martial arts training device according to claim 1 wherein said pliable substrate comprises a sheet of molded synthetic elastic at least two inches thick.

3. The electronic martial arts training device according to claim 1 further including a layer of flexible tinted transparent material disposed in front of said pliable substrate wherein said target lights are visible only when energized.

4. The electronic martial arts training device according to claim 1 wherein each of said plurality of target lights comprises a plurality of light emitting diodes encased within a transparent flexible potting material.

5. The electronic martial arts training device according to claim 4 wherein said transparent flexible potting material is selected to diffuse the light emitted by said plurality of light emitting diodes.

6. The electronic martial arts training device according to claim 4 wherein each of said pluralities of light emitting diodes is arranged in concentric geometric figures and wherein said control means is effective to consecutively illuminate one geometric figure followed by another geometric figure.

7. An electronic martial arts training device comprising:

a pliable substrate of sufficient thickness to absorb a full impact martial arts blow without injuring the deliverer thereof;

a pictorial representation of a plurality of martial arts targets disposed in front of said pliable substrate;

a plurality of target light disposed within said pliable substrate;

a plurality of miniature loud speakers each having vibratable cone and a pair of electrical terminals disposed within said pliable substrate in association with each of said plurality of target lights for generating an electrical signal at each of said pair of electrical terminals in response to the vibration induced in said vibratable cone by a martial arts blow in the vicinity thereof, said electrical signal having an amplitude indicative of the force of said martial arts blow; and control means for selectively illuminating particular ones of said target lights and for coupling said electrical signal from an associated miniature loud speaker for a predetermined period of time thereafter.

8. The electronic martial arts training device according to claim 7 wherein said pliable substrate comprises a sheet of molded synthetic elastic at least two inches thick.

9. The electronic martial arts training device according to claim 7 further including a layer of flexible tinted transparent material disposed in front of said pliable substrate wherein said target lights are visible only when energized.

10. The electronic martial arts training device according to claim 7 wherein each of said plurality of target lights comprises a plurality of light emitting diodes encased within a transparent flexible potting material.

11. The electronic martial arts training device according to claim 10 wherein said transparent flexible potting material is selected to diffuse the light emitted by said plurality of light emitting diodes.

12. The electronic martial arts training device according to claim 10 wherein each of said pluralities of light emitting diodes is arranged in concentric geometric figures and wherein said control means is effective to consecutively illuminate one geometric figure followed by another geometric figure.

13. The electronic martial arts training device according to claim 7 wherein the amplitude of said electrical signal is proportional to the amplitude of said martial arts blow.

14. An electronic martial arts training device comprising:

a pliable substrate of sufficient thickness to absorb a full impact martial arts blow without injuring the deliverer thereof;

a pictorial representation of a plurality of martial arts targets disposed in front of said pliable substrate;

a plurality of target lights disposed within said pliable substrate, each of said plurality of target lights comprising a plurality of light emitting diodes arranged in concentric geometric figures nd encased within a transparent flexible potting material;

a plurality of vibration sensitive transducers each disposed within said pliable substrate in association with one of said plurality of target lights for detecting a martial arts blow in the vicinity thereof; and control means for selectively illuminating particular ones of said plurality of target lights by consecutively illuminating one geometric figure followed by another geometric figure and for enabling an associated vibration sensitive transducer for a predetermined period of time thereafter.

15. The electronic martial arts training device according to claim 14 wherein said pliable substrate comprises a sheet of molded synthetic elastic at least two inches thick.

16. The electronic martial arts training device according to claim 14 further including a layer of flexible tinted transparent material disposed in front of said pliable substrate wherein said target light are visible only when energized.

17. The electronic martial arts training device according to claim 14 wherein each of said plurality of target lights comprises a plurality of light emitting diodes encased within a transparent flexible potting material.

18. An electronic martial arts training device comprising:

a pliable substrate of sufficient thickness to absorb a full impact martial arts blow without injuring the deliverer thereof;

a pictorial representation of a plurality of martial arts targets disposed in front of said pliable substrate;

a plurality of target lights disposed within said pliable substrate, each of said plurality of target lights comprising a plurality of light emitting diodes arranged in concentric geometric figures and encased within a transparent flexible potting material;

a plurality of miniature loud speakers each having a vibratable cone and a pair of electrical terminals disposed within said pliable substrate in association with each of said plurality of target lights for generating an electrical signal at each of said pair of electrical terminals in response to the vibration induced in said vibratable cone by a martial arts blow in the vicinity thereof; and control means for selectively illuminating particular ones of said target lights by consecutively illuminating one geometric figure followed by another geometric figure and for coupling said electrical signal from an associated miniature loud speaker for a predetermined period of time thereafter.

19. The electronic martial arts training device according to claim 18 wherein said pliable substrate comprises a sheet of molded synthetic elastic at least two inches thick.

20. The electronic martial arts training device according to claim 18 further including a layer of flexible tinted transparent material disposed in front of said pliable substrate wherein said target lights are visible only when energized.

21. The electronic martial arts training device according to claim 18 wherein each of said plurality of targets lights comprises a plurality of light emitting diodes encased within a transparent flexible potting material.

22. The electronic material arts training device according to claim 18 wherein said transparent flexible potting material is selected to diffuse the light emitted by said plurality of light emitting diodes.

* * * * *